US005582478A

United States Patent [19]

Ambrosino

[11] Patent Number: 5,582,478

[45] Date of Patent: Dec. 10, 1996

[54] FOOD COVERING SYSTEM WITH ILLUMINATING AND/OR MOVING DECORATIONS

[76] Inventor: Donald J. Ambrosino, 115 N. Main St., Gloversville, N.Y. 12078

[21] Appl. No.: 145,957

[22] Filed: Oct. 29, 1993

[51] Int. Cl.[6] ..... F21V 33/00

[52] U.S. Cl. ..... 362/234; 362/252; 362/251; 362/810; 362/802; 362/276; 362/253; 362/86; 312/284

[58] Field of Search ..... 362/186, 202, 362/392, 249, 276, 802, 810, 253, 806, 252, 251, 295, 254, 250, 86, 234; 439/148, 135; 312/284

[56] References Cited

U.S. PATENT DOCUMENTS

| | | | |
|---|---|---|---|
| 1,125,855 | 1/1915 | Mapes . | |
| 1,707,539 | 4/1929 | Propp . | |
| 2,347,041 | 4/1944 | Filsinger . | |
| 2,986,470 | 5/1961 | Fishmeister . | |
| 3,400,263 | 9/1968 | Yakim | 362/252 X |
| 3,690,902 | 9/1972 | Dahl | 312/284 X |
| 3,736,214 | 5/1973 | McBirnie . | |
| 3,819,455 | 6/1974 | MacKendrick . | |
| 4,187,532 | 2/1980 | Naffier | 362/186 |
| 4,416,075 | 11/1983 | Bauer | 40/540 |
| 4,510,556 | 4/1985 | Johnson | 362/184 |
| 4,721,455 | 1/1988 | Barfus | 431/295 |
| 4,803,604 | 2/1989 | Nichols et al. | 362/154 |
| 4,866,580 | 9/1989 | Blackerby | 362/205 |
| 4,884,966 | 12/1989 | Wexler | 431/295 |
| 4,938,688 | 7/1990 | Wexler | 431/295 |
| 5,006,971 | 4/1991 | Jenkins | 362/252 |
| 5,174,645 | 12/1992 | Chung | 362/86 |

FOREIGN PATENT DOCUMENTS 550274 5/1932 Germany .

OTHER PUBLICATIONS

Science Fair 200 in 1 Electronic Pocket Kit instruction pages; Radio Shack.

*Primary Examiner*—Ira S. Lazarus
*Assistant Examiner*—Thomas M. Sember
*Attorney, Agent, or Firm*—Heslin & Rothenberg, P.C.

[57] ABSTRACT

A food covering system resembling a decorated cake includes a cover with receptacles for holding and providing power to illuminating decorations and/or moving decorations, including electronic candles. In response to a breath sensor sensing a predetermined level of air movement, power to the electronic candles is turned off and secondary illuminating decorations, such as letters arranged in a birthday message, are turned on. In addition to the secondary decorations, music or other sounds may be issued from a speaker embedded in the food cover. The secondary decorations and/or music may be turned on for a predetermined time. Alternatively, the secondary decorations and/or music are on with the electronic candles and remain on, after the candles are "blown out", for a predetermined time.

24 Claims, 4 Drawing Sheets

FOOD COVERING SYSTEM WITH ILLUMINATING AND/OR MOVING DECORATIONS

BACKGROUND OF THE INVENTION

1. Technical Field

The present invention generally relates to food covers. More particularly, the present invention relates to food covers integrated with electrically illuminating decorations and/or moving decorations and/or sound.

2. Background Art

Cakes and other foods are often displayed prior to and/or during a meal for social or ceremonial purposes. Often, the food is left open to the air and is subjected to environmental contaminants, such as smoke or germs from sneezing or coughing. For example, birthday cakes are displayed at birthday parties with wax candles and other decorations inserted into the cake. The wax candles drip wax onto the cake and when the candles are blown out, germs are sprayed over the surface of the cake. In addition, conventional candles may cause serious burns, especially in children, or may ignite flammable chemicals, gases or materials.

Covers have been developed to shield the cake or other food from such environmental contaminants. Covers have also been developed that provide for attaching decorations, including wax candles, to the outside of the cover so that the display tradition is maintained. Some covers have even allowed for illuminating decorations to be attached to the outside thereof, such as devices simulating a burning candle. In addition, though not used in conjunction with food display, at least one electronic candle has been developed that includes a sensor for sensing the candle being "blown out" by a person and turning off the candle in response thereto.

While the above food covers have allowed for protection of the food while maintaining some decorative aspects, the extent of the usefulness of such covers has gone Unrealized. For example, the present covers do not allow for illuminating words or numbers, for moving decorations or for music or other sounds to be integrated with the food presentation.

Thus, a need exists for a food covering system with an array of illuminating and/or moving decorations and flexibility in their arrangement, as well as for a food covering system integrated with sound.

SUMMARY OF THE INVENTION

Briefly, the present invention satisfies the need for a flexible food covering system by providing a food covering system capable of being decorated with an array of electrically illuminating and/or moving decorations, as well as having sound capabilities.

A decorative food covering system for shielding food from environmental contaminants is provided comprising a means for covering the food including a bottom and a cover, one or more electrical receptacles in a first area of said cover for accepting one or more electrical decorations one or more sensors on said cover for sensing a predetermined stimulus in close proximity to the one or more receptacles in the first area, a means for automatically turning off power to the first type of decorations in response to the sensors sensing the predetermined stimulus, one or more electrical receptacles in a second area of the cover for accepting on or more electrical decorations and a means for automatically turning on power to the one or more receptacles in the second area in response to power to the one or more receptacles in the first area being turned off of a second type in close proximity to the outer portion of the covering means.

The present invention also contemplates a height-adjustable covering means and means for issuing one or more sounds in response to the sensors sensing the predetermined stimulus. In addition, the one or more sounds may be issued and/or the of decorations in the second area may be on for a predetermined time period.

These, and other objects, features and advantages of this invention will become apparent from the following detailed description of the various aspects of the invention taken in conjunction with the accompanying drawings.

BEST MODE FOR CARRYING OUT THE INVENTION

Figure 1:
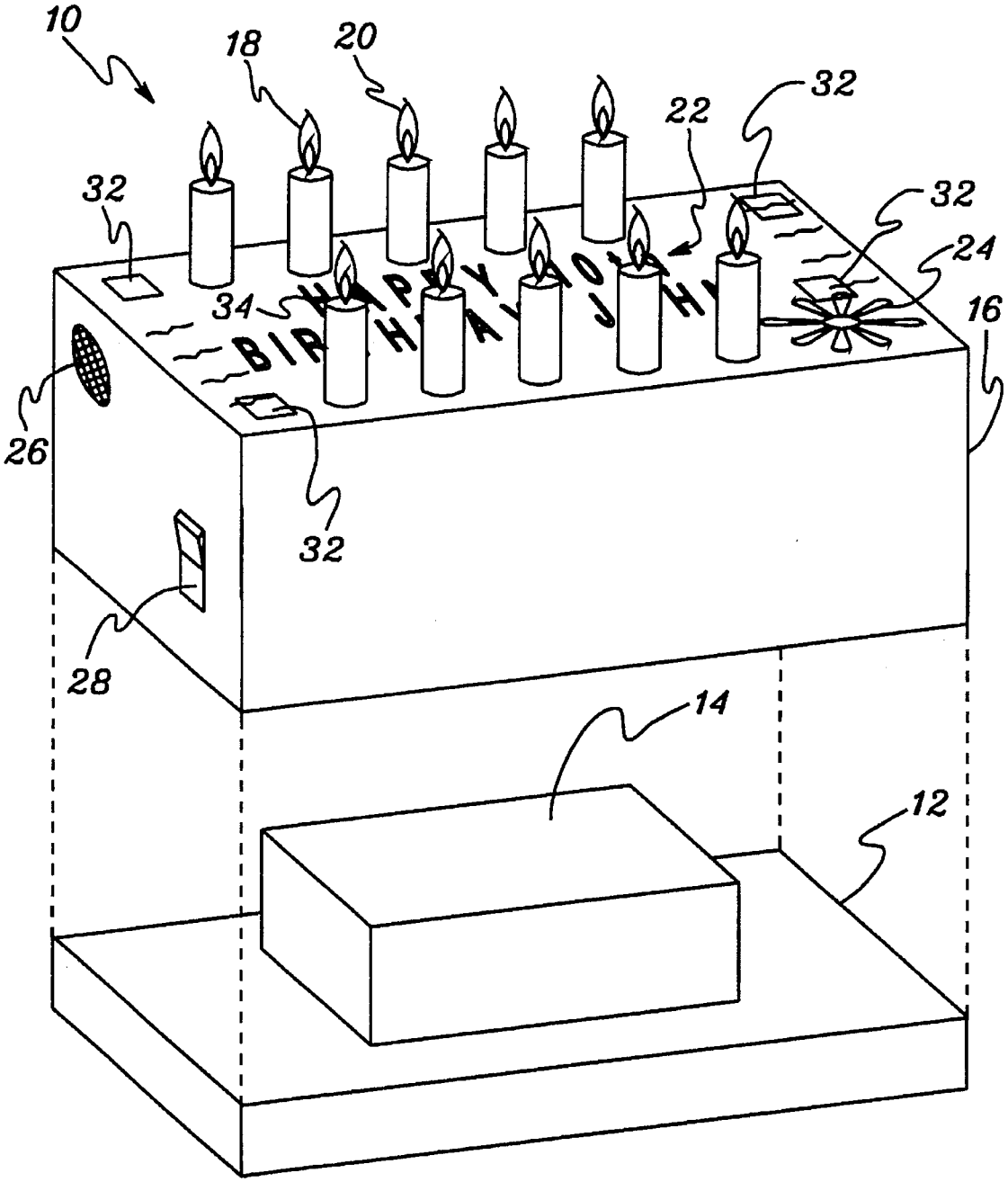
FIG. 1 depicts a food covering system according to the present invention.

FIG. 1 depicts a food covering system 10 according to the present invention. Food covering system 10 includes bottom portion 12 with cake 14 placed thereon. Cover 16 includes electronic candles (e.g., 18 and 20), illuminating birthday message 22, illuminating flower 24, sound speaker 26, on/off switch 28 and breath sensors 32. Although FIG. 1 depicts four breath sensors 32, it will be understood that no particular number or arrangement is required; FIG. 1 is merely one example of a particular use for a food covering system according to the present invention. In addition, it will further be understood that, although cover 16 and bottom layer 12 are depicted in FIG. 1 as rectangular, they could be of different shapes, for example, round.

Cover 16 is placed over cake 14 and fits snugly with bottom 12 to create an air-tight seal preventing environmental contaminants from contacting cake 14. Bottom portion 12 may have lights around its edges for independent use as an illuminated serving tray. In a first aspect, once on/off switch 28 is turned on, the electronic candles become illuminated. In a traditional birthday ceremony, the one having a birthday attempts to blow out the candles. When breath sensors 32 sense at least a predetermined minimum level of air movement, the electronic candles (e.g., 18 and 20) are "extinguished" (i.e., they are automatically turned off). Blowing out all the electronic candles triggers the illumination of birthday message 22, "Happy 10th Birthday John", as well as flower decoration 24. This may be accomplished by, for example, independently providing power to dedicated areas of cover 16 for the electronic candles and the other decorations. As another example, each candle could have its own breath sensor along with circuitry for turning the candle off in response to detecting air movement of a sufficient amount. Electronic candles with these capabilities exist in the art. See, for example, U.S. Pat. No. 4,187,532 issued to Naffier entitled "Electronic Candle". Shown in Naffier is a battery operated candle that turns off in response to appropriate air movement near the sensor. It will be understood by one skilled in the art that the electronic candles could also comprise, for example, LEDs. Birthday message 22 comprises individual removable characters, e.g. letter "H" 34. In addition, the extinguishing of the electronic candles (e.g., 18 and 20) triggers music or other sounds from speaker 26.

Cover 16 may be clear, in order to view the food thereunder, or it may be colored, for example, to simulate frosting. In addition, cover 16 could be textured to, for example, simulate frosting.

In a second aspect, birthday message 22 and flower 24 are illuminated along with the electronic candles and remain illuminated after the electronic candles have been extinguished. In this second aspect, no separate power would be needed if each electronic candle had a breath sensor and the capability of turning itself off in response to appropriate air movement near the sensor.

Figure 2:
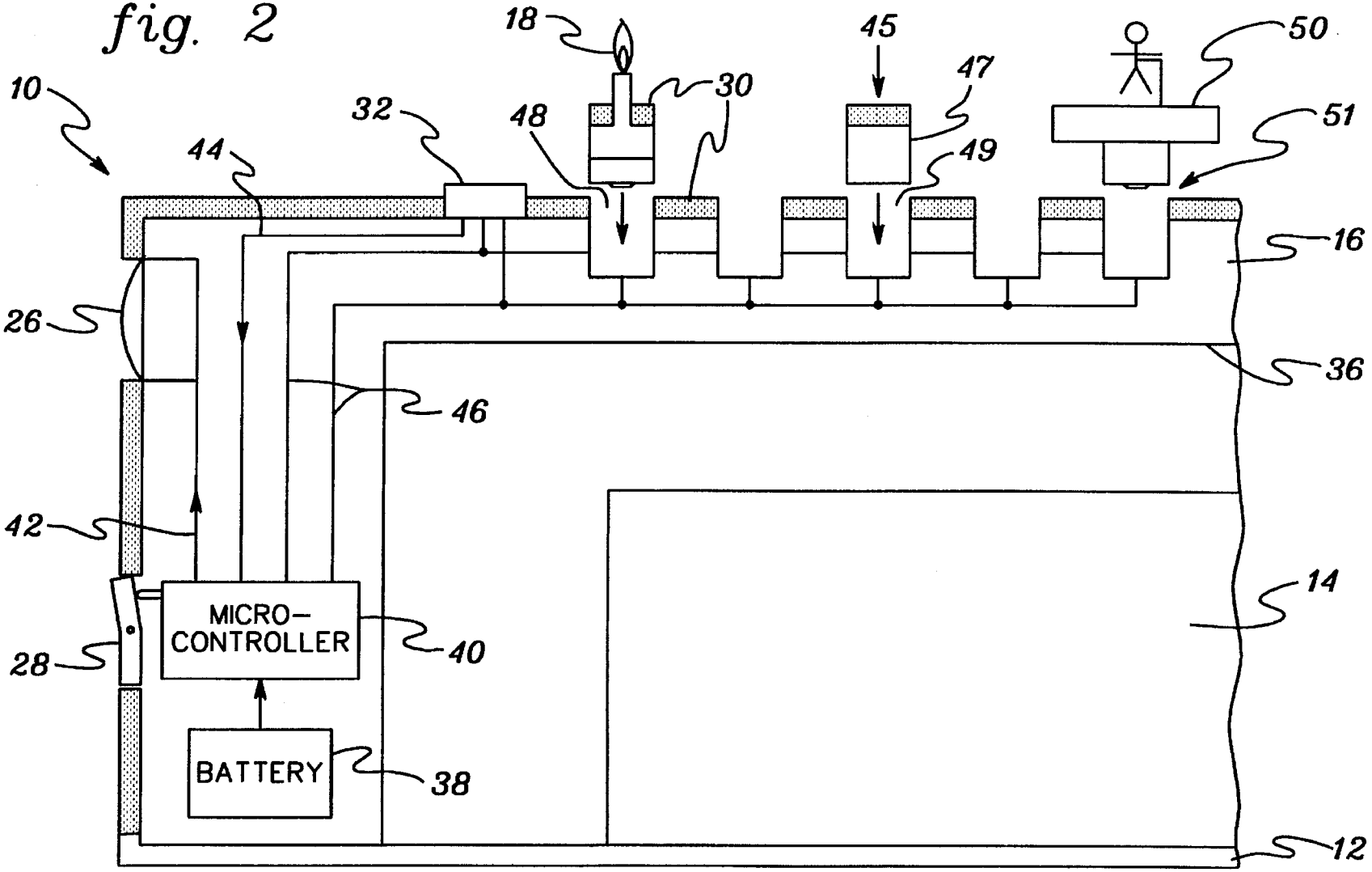
FIG. 2 is a cross-sectional view of a portion of the food covering system of FIG. 1.

FIG. 2 is a detailed cross-sectional view of a portion of the food covering system 10 of FIG. 1 with cover 16 over cake 14 and bottom portion 12. Also included in FIG. 2 is movable decoration 50 comprising a miniature ballet dancer. Cover 16 further comprises inner layer 36, battery 38, and microcontroller 40. Preferably, inner layer 36 is electrically insulating. The use of a centralized power source (i.e., battery 38) is preferred over individual battery-powered decorations for efficiency reasons. For safety and portability reasons, a battery-type power source is preferred over a conventional power supply with power cord and plug for use with conventional electrical outlets. Microcontroller 40 is turned on and off via on/off switch 28. Microcontroller 40 functions to, among other things, provide a sound signal to speaker 26 over line 42, receive an air movement signal from breath sensor 32 over line 44 and provide power to row 51 and breath sensor 32 over lines 46. Candle.18 is shown in FIG. 2 being placed in receptacle 48 of row 51.

Figure 3:
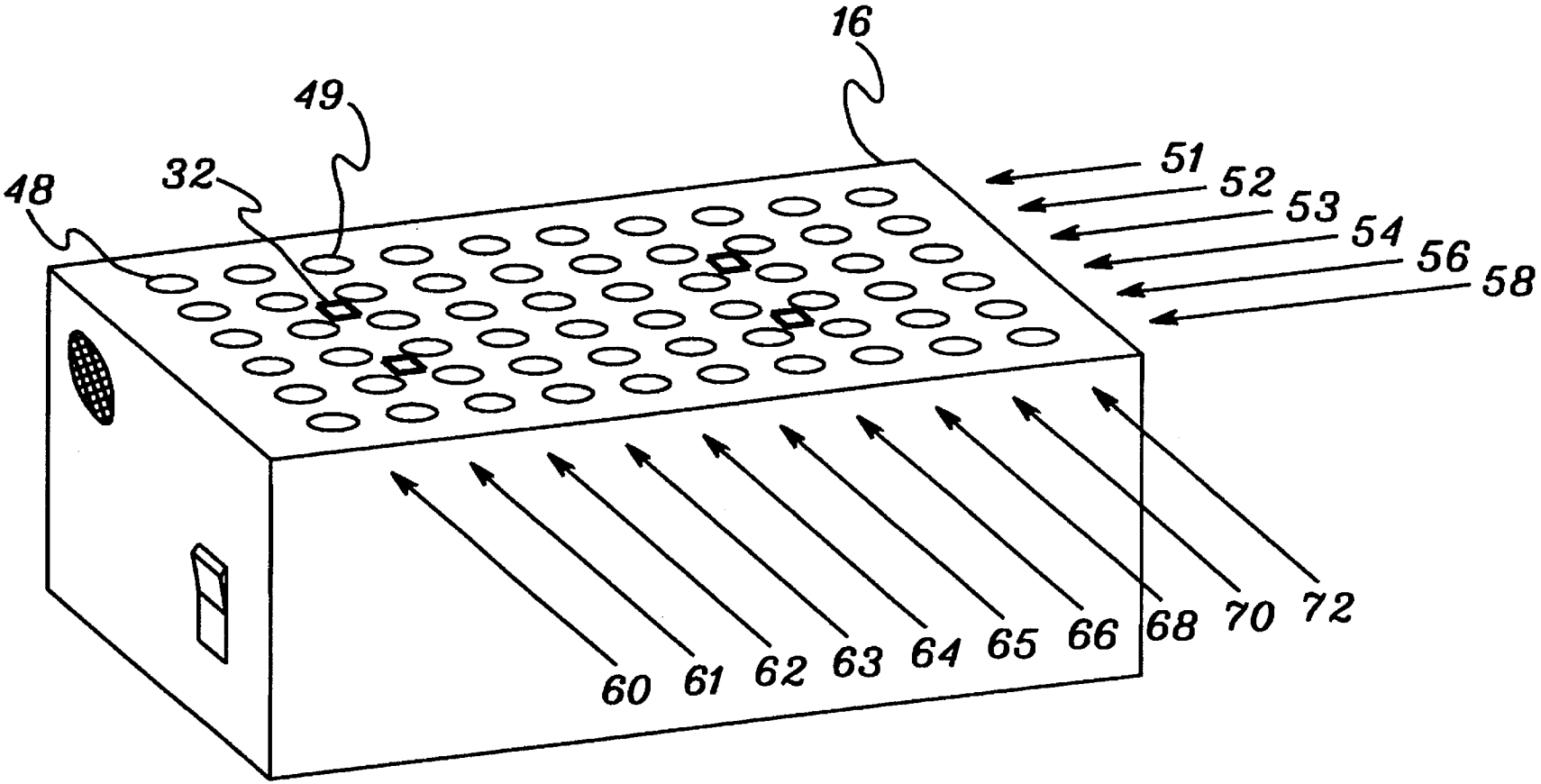
FIG. 3 depicts the cover portion of the food covering system of FIG. 1 with the decorations removed therefrom.

FIG. 3 depicts a top view of cover 16 without decorations. Cover 16 has a plurality of decoration receptacles, e.g., receptacle 48, embedded in the top thereof. The receptacles are arranged, for example, in rows 51 through 58 and columns 60 through 72. In one aspect, one or more rows and/or columns are reserved for electronic candles, while the remaining rows/columns are for general use. The power to the one or more rows and/or columns used for electronic candles is independently controlled with respect to the rows/columns for general purpose use. This arrangement allows the power to the electronic candles to be removed when they are "blown out", i.e., the breath sensors sense the predetermined minimum level of air movement, while still supplying power to the general purpose area.

The operation of food covering system 10 will now be described with reference to FIGS. 2 and 3. After the food to be covered, in this case cake 14, is placed on bottom portion 12, cover 16 is placed thereover and sealed, providing a protective environment for the food. Electric candles and/or other illuminating decorations are then arranged by placing them in the decoration receptacles, e.g., receptacle 48, in a desired pattern. Rows 51 and 58 are reserved in the present example for decorations that are to automatically turn off when a stimulus, in this case air movement of at least a predetermined minimum level, is sensed. Thus, in the present example, rows 51 and 58 are reserved for electronic candles, such as candle 18. Any receptacles not used, e.g., receptacle 49, are filled with a non-conductive dummy plug 47 having a surface 45 resembling the surface 30 of cover 16.

After the decorations have been placed and any unused receptacles filled with dummy plugs, microcontroller 40 is turned on by pressing switch 28. Upon pressing switch 28, microcontroller 40 provides power over lines 46 to breath sensors 32 and rows 51 and 58 to illuminate the electronic candle 18. A similar arrangement (not shown) is provided for row 58. When breath sensors 32 sense a predetermined minimum level of air movement in close proximity thereto, a signal to that effect is issued to microcontroller 40 over line 44. Upon receiving the air movement signal, microcontroller 40 removes power from sensors 32 and rows 51 and 58. Simultaneously, power is provided to rows 52 through 56 to illuminate the non-candle decorations, e.g., movable decoration 50 begins to move. In addition, music or other sounds are issued over speaker 26 via a signal from microcontroller 40 over line 42 for a predetermined time. Microcontroller 40 could be, for example, preprogrammed with music to be played, or, as another example, accept inserts with the music to be played. As a further example, the music means could also be a tape or CD player controlled by microcontroller 40 which accepts tapes or CD's from the user. After the predetermined time, microcontroller 40 removes power from rows 52 through 56, stops issuing sounds from speaker 26 and turns itself off. When microcontroller 40 is turned on again, the above process repeats.

Figure 4:
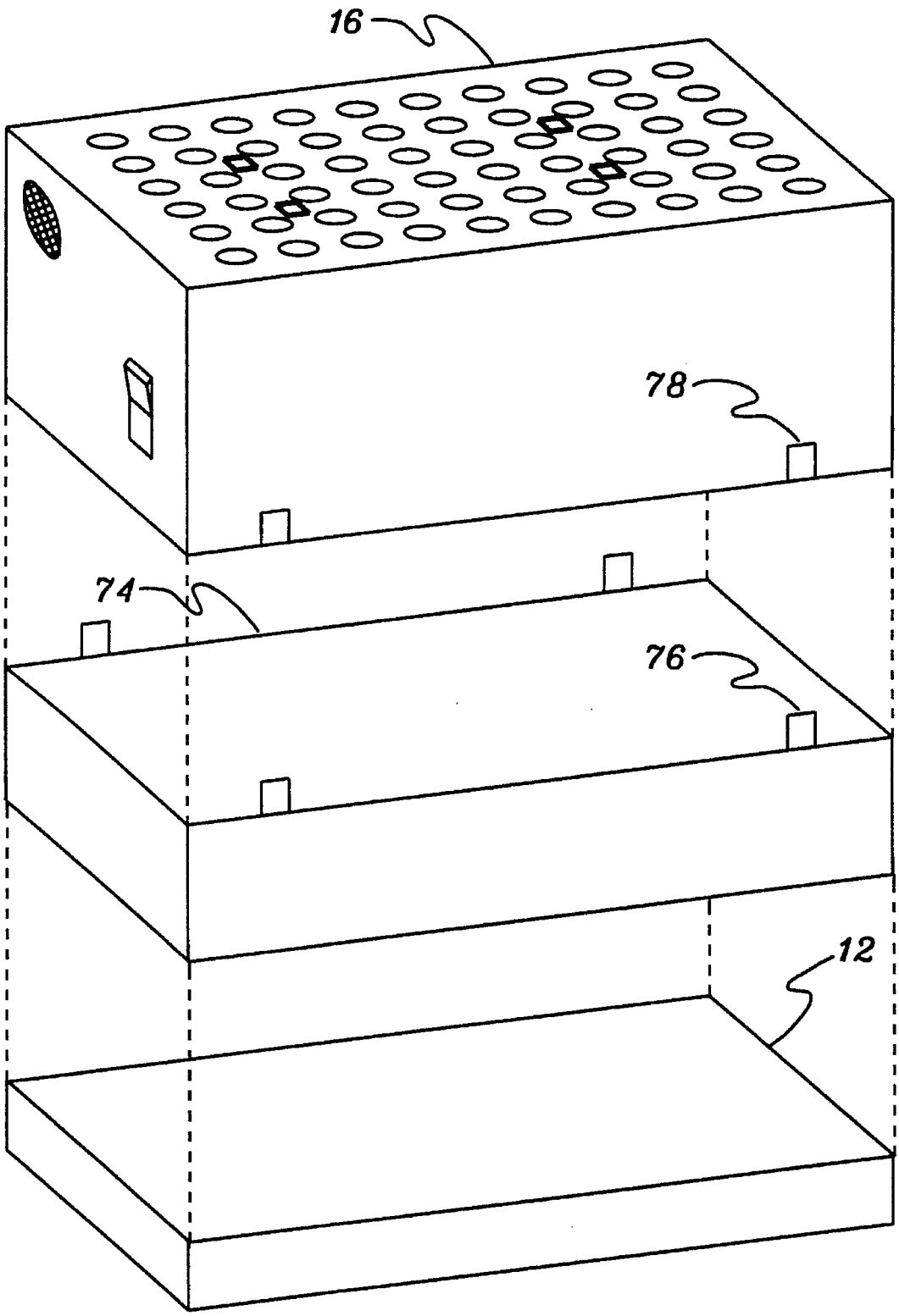
FIG. 4 depicts the food covering system of FIG. 3 with an additional interlocking layer.

FIG. 4 depicts the cover 16 of FIG. 3 along with the bottom layer 12 of FIG. 1 and an additional layer 74 to increase the height thereof. Layers 16 and 74 interlock via stub 76 and recessed notch 78 for receiving stub 76.

While several aspects of the present invention have been described and depicted herein, alternative aspects may be effected by those skilled in the art to accomplish the same objectives. Accordingly, it is intended by the appended claims to cover all such alternative aspects as fall within the true spirit and scope of the invention.

I claim:

1. A decorative food covering system for shielding food from environmental contaminants, comprising:

means for covering said food, said covering means comprising a bottom and a cover;

one or more electrical receptacles in a first area of said cover for accepting one or more electrical decorations;

one or more sensors on said cover for sensing a predetermined stimulus in close proximity to said one or more receptacles in said first area;

means for automatically turning off power to said one or more receptacles in said first area in response to said one or more sensors sensing said predetermined stimulus;

one or more electrical receptacles in a second area of said cover for accepting one or more electrical decorations; and means for automatically turning on power to said one or more receptacles in said second area in response to power to said one or more receptacles in said first area being turned off.

2. A decorative food covering system according to claim 1, wherein:

said one or more electrical decorations in said first area comprises an electronic candle; and said one or more sensors comprises a breath sensor for sensing a predetermined minimum level of air movement in close proximity to said electronic candle.

3. A decorative food covering system according to claim 2 wherein said electronic candle comprises said breath sensor.

4. A decorative food covering system according to claim 1 wherein said one or more electrical decorations in said second area comprises a letter.

5. A decorative food covering system according to claim 1 wherein said one or more electrical decorations in said second area comprises a number.

6. A decorative food covering system according to claim 1 wherein said one or more electrical decorations in said second area comprises a flower.

7. A decorative food covering system according to claim 1 wherein said one or more electrical decorations in said second area comprises a moving decoration.

8. A decorative food covering system according to claim 1 further comprising means coupled to and hidden by said covering means for providing power to said one or more electrical decorations.

9. A decorative food covering system according to claim 8 wherein said power providing means independently provides power to said first area and said second area.

10. A decorative food covering system according to claim 1 wherein said covering means comprises a height-adjustable covering means.

11. The decorative food covering system of claim 10 wherein said height-adjustable covering means comprises at least two interlocking layers.

12. A decorative food covering system according to claim 1 further comprising a plug for covering any of said one or more receptacles in said first area and said second area.

13. A decorative food covering system according to claim 1 wherein said one or more electrical receptacles in said second area are automatically provided with power for a predetermined time period in response to power to said one or more receptacles in said first area being turned off.

14. A decorative food covering system according to claim 1 further comprising means for issuing one or more predetermined sounds.

15. A decorative food covering system according to claim 14 wherein said sound issuing means comprises means for issuing said one or more predetermined sounds in response to said one or more sensors sensing said predetermined stimulus.

16. A decorative food covering system according to claim 14 wherein said sound issuing means comprises means for issuing said one or more predetermined sounds for a predetermined time period.

17. A decorative food covering system for covering food, comprising:

height-adjustable means for covering said food;

a plurality of electronic candles in close proximity to said height-adjustable covering means;

means for turning on said plurality of electronic candles;

means for issuing one or more predetermined sounds;

means coupled to said height-adjustable covering means for supporting and providing power to said plurality of electronic candles;

one or more breath sensors for sensing a predetermined minimum level of air movement in close proximity to said plurality of electronic candles;

means for automatically turning off said plurality of electronic candles in response to said one or more breath sensors sensing said predetermined minimum level of air movement; and one or more non-candle electrically illuminating decorations automatically turning on in response to said one or more breath sensors sensing said predetermined level of air movement.

18. A decorative food covering system according to claim 17, wherein said sound issuing means comprises means for issuing said one or more predetermined sounds in response to said one or more breath sensors sensing said predetermined level or air movement.

19. A decorative food covering system according to claim 18, wherein said sound issuing means comprises means for issuing said one or more predetermined sounds for a predetermined time period.

20. A decorative food covering system according to claim 17 wherein said height-adjustable covering means resembles a frosted cake.

21. A decorative food covering system according to claim 17 wherein each of said plurality of electronic candles comprises one of said one or more breath sensors and an independent means for automatic turn-off thereof.

22. A decorative food covering system for shielding food from environmental contaminants, comprising:

means for covering said food, said covering means including a bottom and a cover, said cover comprising a plurality of decoration receptacles arranged in rows and columns on said cover, each of said plurality of decoration receptacles providing stability and power to an electrical decoration;

means for independently controlling power to a first group and a second group of said plurality of decoration receptacles; and means for sensing a predetermined stimulus, wherein said power controlling means removes power from said first group in response to said sensing means sensing said predetermined stimulus.

23. The decorative food covering system of claim 22 wherein said power controlling means supplies power to said second group in response to said sensing means sensing said predetermined stimulus.

24. A decorative food covering system for shielding food from environmental contaminants, comprising:

means for covering said food, said covering means including a bottom and a cover, said cover comprising a plurality of decoration receptacles arranged in rows and columns on said cover, each of said plurality of decoration receptacles providing stability and power to an electrical decoration;

means for independently controlling power to a first group and a second group of said plurality of decoration receptacles; and means for sensing a predetermined stimulus, wherein said power controlling means supplies power to said second group in response to said sensing means sensing said predetermined stimulus.

* * * * *